US005186395A

United States Patent [19]

Brody

[11] Patent Number: 5,186,395

[45] **Date of Patent: * Feb. 16, 1993**

[54] AIR POWERED PARTICLE SPRAYER WITH AIR FLOW CONTROL MEANS

[76] Inventor: David E. Brody, 2800 S. University Blvd., No. 128, Denver, Colo. 80210

[ * ] Notice: The portion of the term of this patent subsequent to Jan. 30, 2007 has been disclaimed.

[21] Appl. No.: 794,715

[22] Filed: Nov. 15, 1991

Related U.S. Application Data

[63] Continuation of Ser. No. 471,859, Jan. 29, 1990, abandoned, which is a continuation-in-part of Ser. No. 266,399, Jul. 29, 1988, Pat. No. 4,896,833.

[51] Int. Cl.[5] ..... B05B 7/30

[52] U.S. Cl. ..... 239/654; 239/318; 239/340; 222/255

[58] Field of Search ..... 239/355, 357, 360, 654, 239/318, 340; 222/401, 402, 255

[56] References Cited

U.S. PATENT DOCUMENTS

| | | | |
|---|---|---|---|
| Re. 29,176 | 4/1977 | Loeffler | 239/357 X |
| 1,860,136 | 5/1932 | Bunch | 239/373 X |
| 1,930,872 | 10/1933 | Blackmun | 239/355 |
| 2,391,048 | 12/1945 | Vose | 239/654 |
| 2,712,472 | 7/1955 | Florjancic | 239/355 |
| 3,369,757 | 2/1968 | Boris | 239/355 |
| 3,790,034 | 2/1974 | Horvath | 239/373 X |

FOREIGN PATENT DOCUMENTS

| | | | |
|---|---|---|---|
| 1210131 | 2/1966 | Fed. Rep. of Germany | 239/357 |
| 443549 | 12/1948 | Italy | 239/357 |

*Primary Examiner*—Andres Kasnikow
*Assistant Examiner*—Kevin Weldon
*Attorney, Agent, or Firm*—Gregg I. Anderson

[57] ABSTRACT

A particle sprayer includes a hollow body divided into an air compartment and a storage compartment for particulate material. The air compartment receives a piston which is manually slidable along the length of the air compartment to create air pressure within the air compartment. An air passageway provides air flow communication between the air compartment and the exterior of the sprayer. A discharge tube extends into the material in the storage compartment at one end and at the other end intersects the air passageway near a restriction in the air passageway defining a venturi opeing. Depression of the piston creates increased positive air flow exiting the sprayer the venturi opening and the resultant low pressure area draws material up the discharge tube from the storage compartment to be dispersed in a uniform amount into the air in the air passageway and ejected from the sprayer as a spray. Air flow control means lowers the pressure in the down pressure area during negative air flow into the sprayer as the piston raises in the air compartment.

11 Claims, 1 Drawing Sheet

AIR POWERED PARTICLE SPRAYER WITH AIR FLOW CONTROL MEANS

CROSS REFERENCE TO RELATED APPLICATION

The present application is a continuation of U.S. patent application Ser. No. 07/471,859 now abandoned, filed Jan. 29, 1990, which was a continuation-in-part of U.S. application Ser. No. 07/266,399 filed Jul. 29, 1988, now U.S. Pat. No. 4,896,833.

BACKGROUND OF THE INVENTION

1. Field of the Invention

The present invention relates generally to salt, pepper and granular, powdery, or other particle condiment dispensers. More particularly, the present invention relates to sprayers utilizing air pressure within a container to eject particles stored within the container to form a spray of air and suspended particles.

2. Description of the Prior Art

The common and readily available salt and pepper shaker, as well as similar structures for other condiments, are well known. The salt and pepper, hereinafter referred to generally as particulate material, are stored within a container and poured from the container onto food through a pattern of holes in a top of the container. The principal drawback to the common device is the inability to measure even reasonably precisely the amount of particulate material to be deposited onto the food. In addition, material is easily spilled if the common devices are turned over or upset for any reason.

U.S. Pat. No. 2,609,971 to M. Vivolo shows a salt dispenser in which salt flows by gravity into an air passage in a small but uncontrolled accumulation. Squeezing a bulb generates a pulse of compressed air, which flows through the passage and carries the salt out of the dispenser. Vivolo incorporates a storage area with a convex bottom having a hole at the lowermost position for the feeding of the particulate material through the hole and into the passage. The passage communicates with the bulb to receive compressed air to force the particulate material through a projecting nipple for dispensing onto the food.

The difficulty with Vivolo, as well as all of the prior art using air pressure to force particulate material along a passage, is that the air which flows along the passage must force the material directly from the dispenser. This process has three drawbacks. Firstly, the passage is more likely to be clogged by the particulate material as some material is pushed by air pressure, while other material is moved by collisions with the material directly influenced by air pressure. Secondly, the particulate material is not necessarily dispersed evenly into the spray of air by the pulse of air generated. Thirdly, it is not likely that any preselected amount of particulate material will be dispensed, since the volume of the passage available for a pulse of air is not controlled nor controllable.

Italian Patent No. 449,894 is also a sprayer utilizing a piston and bellows to eject particulate material from the device. As in Vivolo the material is deposited into a passage and then air pressure is used to eject the material. A linkage meters the particulate material into the passage tube.

U.S. Pat. No. 3,785,568 to E. Pfingsten passes a gaseous fluid at pressure through a tube which intersects and communicates with a second depending tube. The depending tube extends into a reservoir of material. The passage of the gaseous fluid develops a low pressure area in the depending tube which causes the material to be elevated into the gaseous fluid stream and carried away. Pfingsten does not use direct air pressure to move particulate material and therefore defines a more evenly dispersed spray. However, Pfingsten still moves material with direct air pressure down a common feed tube, which is more likely to be clogged.

U.S. Pat. No. 2,126,924 to W. Rose is a dust sprayer utilizing a manually operated plunger to force air through openings over one end of a tube. The other end of the tube communicates with a dust filled zone above powder stored in a container. The air flow generated by the plunger over the openings generates a low pressure zone, which draws dust up the tube. The same plunger action forces air down another tube and through a powder body to enhance the efficiency of the sprayer by creating a dust cloud into which the first tube depends. Rose is similar to Pfingsten in using high velocity air, created by a plunger, to draw powder into a tube by creating a low pressure zone.

U.S. Pat. No. 4,120,427 to J. McRoskey, et al. shows a powder container including an annular air channel through which air is forced by the action of a diaphragm. This action reduces the volume of the container. Venturi openings connect the interior of the container with a channel which allows powder to be drawn into the channel and exhausted through a discharge nozzle.

U.S. Pat. No. 1,554,991 to J. Crowley forces air through a nozzle to draw powder from a reservoir. Crowley uses gravity in combination with air pressure to move the powder.

U.S. Pat. No. 2,202,079 to W. Ayres shows a dispenser for powder which employs air flow through tubes to generate suction at venturi locations, drawing powder into the air flow for transport out of the dispenser. Again, positive air pressure, rather than negative or low pressure, is used to move the material.

U.S. Pat. No. 2,358,329 to E. Houghton compresses air in a chamfer by depression of a member, forcing air through a tube, past a slot and to a tube exit. The slot communicates with powder in a container. The passage of the high pressure air over the slot draws powder into the air stream under the influence of the low pressure thereby created.

U.S. Pat. No. 3,904,087 to J. McRoskey, et al. uses a longitudinally extending tube with spaced venturi openings to pull powder into an air stream passing vertically upward through the tube. Squeezing and releasing an outer container forces the material from an inner container into the tube, through a nozzle, ejecting the material from the device.

My copending patent, U.S. Pat. No. 4,896,833, is similar to the present invention. However, that patent does not control air flow after a piston has been activated to spray the particulate material.

OBJECTS AND SUMMARY OF THE INVENTION

It is the principal object of the present invention to provide an air powered dispenser for spraying particulate material using positive air flow to create a low pressure area to draw particulate material from the bottom of the dispenser and to then eject the particulate material in an evenly dispersed spray, while preventing negative air flow from establishing a back pressure drawing the particulate material into an air compartment of the dispenser.

In accordance with the object of the invention, a particulate material sprayer includes a container divided into an upper air compartment and a lower storage compartment. The air compartment is separated from the storage compartment by a mid portion bulkhead. A piston or air moving means is slidably mounted in the air compartment and is biased away from the bulkhead by a spring. Manual downward displacement of the piston forces air from the air compartment through an air passageway creating a positive air flow out of the sprayer.

A vertical tube extends downwardly into the storage compartment, which storage compartment holds salt, pepper or other condiments, hereinafter referred to as particulate material. The vertical tube is in air flow communication with the air passageway. A venturi opening is located in the air passageway at the intersection of the vertical tube and the air passageway. High pressure or compressed air in the air passageway results from downward movement of the piston in the air compartment. The air flows in a positive flow direction past the venturi opening at an increased velocity and creates a low pressure area or zone at the top of the vertical tube. The low pressure zone draws particulate material from the storage compartment via the vertical tube. The material is dispersed into the air ejecting from the sprayer through an outlet, creating a spray of air dispersed with suspended material. The creation of a low pressure area by a venturi opening removed from the particulate material minimizes the chances of clogging the air passageway or the vertical tube. Each actuation of the piston disperses a spray having an amount of material which is directly proportional to the extent that the piston is depressed.

After the piston has been compressed, it is released and moves upwardly in the air compartment under the influence of the spring. This upward movement of the piston in the air compartment establishes an air flow in a negative flow direction over the vertical tube. A low pressure area is again created that tends to draw particulate material from the storage compartment. Were particulate material drawn up the vertical tube and into the air passageway, there is a likelihood that some particulate material would enter the air compartment and interfere with the operation of the piston. Means for controlling air flow include a relief passageway and a one-way or non-return valve formed in the sprayer. Air flow communication between the air compartment and the outside ambient air is established through the relief passageway. The one-way valve prevents positive air flow from exiting the sprayer through the relief passageway when the sprayer is actuated. The release of the piston, and the creation of a negative air flow, allows the relief passageway and associated one-way valve to draw air into the air compartment of the dispenser, preventing negative air flow from raising any particulate material from the storage compartment.

DESCRIPTION OF THE PREFERRED EMBODIMENT

Figure 1:
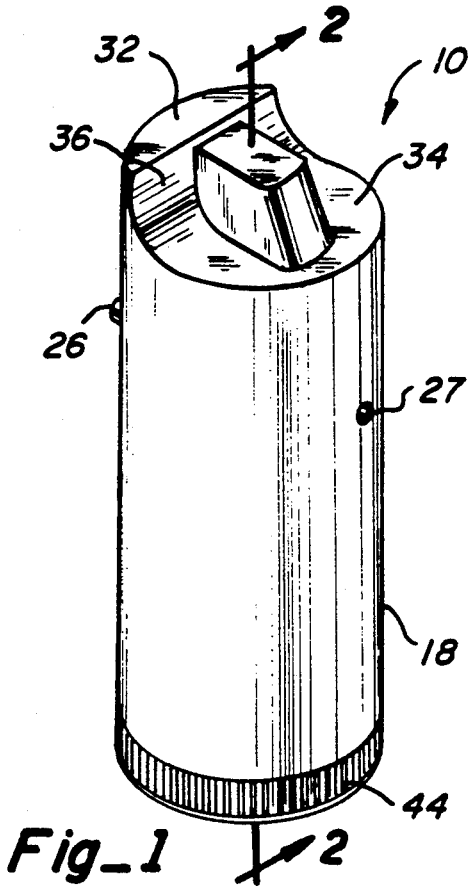
FIG. 1 is a perspective view of a particle sprayer of the present invention.
Figure 3:
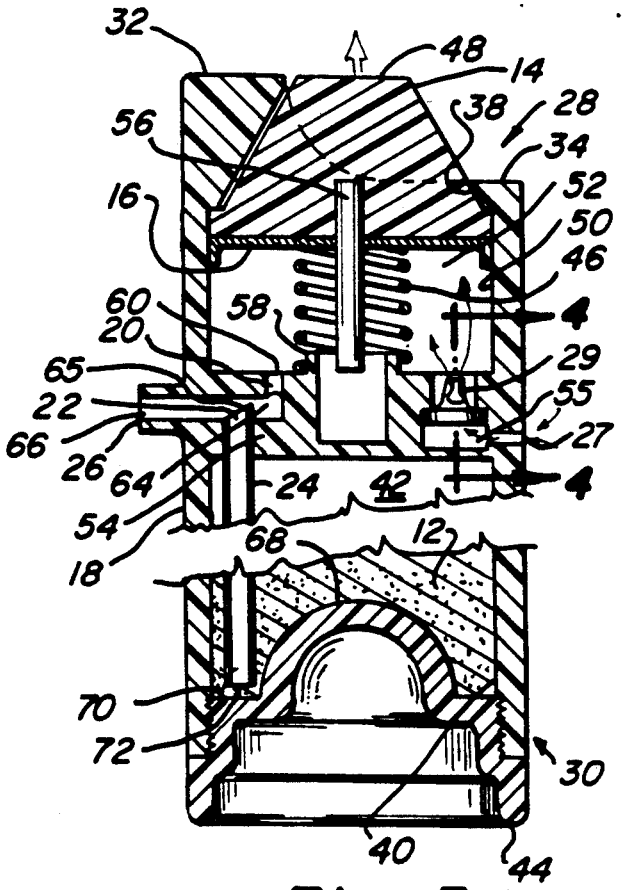
FIG. 3 is a fragmentary sectional view similar to FIG. 2, the sprayer shown creating a negative air flow entering the sprayer.

Referring first to FIG. 1, a particle sprayer 10 is used to dispense a spray 11 (FIG. 2) of air and salt, pepper or other condiment, hereinafter referred to as particulate material 12. (FIG. 3). The sprayer 10 is particularly useful to dispense, in the spray 11 of air and suspended particulate material 12, a predetermined amount of the material 12. The spray 11 dispenses the material 12 at the predetermined amount by manually pressing a button 14 to the limit of its downward motion. Lesser amounts can be measured by depressing the button 14 over lesser downward motions.

Figure 2:
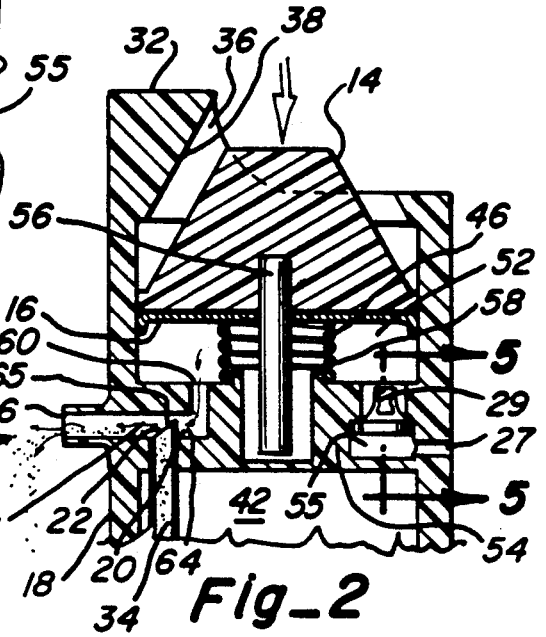
FIG. 2 is a fragmentary sectional view taken along line 2—2 of FIG. 1, the sprayer shown spraying particulate material and creating a positive air flow exiting the sprayer.

As seen in FIGS. 2 and 3, the button 14 is integrally connected to a circular piston 16, comprising air moving means, which slides along an inner surface of a main body 18 of the sprayer 10. The movement of the piston 16 creates a positive air flow out of the sprayer 10 and along an air passageway 20 of essentially constant cross sectional area and past an outlet orifice 22 of a vertical discharge tube 24. The tube 24 extends into the air passageway 20 to provide air flow communication between the tube 24 and the air passageway 20. The tube 24 partially closes the air passageway 20, forming a restriction in the cross sectional area of the air passageway 20, hereinafter referred to as a venturi opening 64.

The other end of the tube 24 is inserted into the particulate material 12. Low pressure developed at the outlet orifice 22, located immediately adjacent the venturi opening 64, draws the particulate material 12 up the discharge tube 24, where the material 12 is mixed with the air in the passageway 20. An outlet 26 formed in the main body 18 is immediately downstream of the outlet orifice 22 and registers with the air passageway 20. The material 12 is dispersed into the air and ejected from the sprayer 10 through the outlet 26. The result is an even dispersion of the particulate material 12 with the air. The chance of blocking either the air passageway 20 or the discharge tube 24 is significantly reduced.

Figure 4:
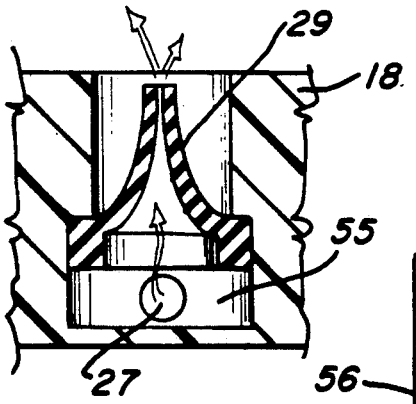
FIG. 4 is an enlarged fragmentary sectional view taken in the plane of line 4—4 of FIG. 3.

To further reduce the chance of blocking the air passageway 20, or even drawing material into an air compartment 52 within which the piston 16 slides, an air relief passageway 27 and one-way or non-return valve 29 (FIGS. 4 and 5) formed interiorly of the main body 18. The relief passageway 27 provides air flow communication between the air compartment 52 and the exterior of the sprayer 10. Blockage of the air passageway 20 is prevented by controlling the air flow path out of the sprayer 10, the positive air flow (FIG. 5), as well as the air flow path into the sprayer 10, negative air flow (FIG. 4). The one way valve 24 insures that during positive air flow, as the piston 16 is depressed, all of the air in the air compartment 52 is directed along the passageway 20. Similarly, upon release of the button 14 and the raising of the piston 16, at least some air flows into the sprayer 10 along relief passageway 27 and past the one-way valve 29, rather than principally along the air passageway 20 and past the venturi 64 in a manner which might raise some of the material 12 in the tube 24 and deposit it in the air passageway 20. It is important to keep the air passageway 20 clear of particulate material so that there is a minimal chance of any of the particulate material entering the air compartment 52 and possibly damaging the seal between the piston 16 and an inner surface 50 of the air compartment 52.

The main body 18 is of generally cylindrical shape and of a suitable size to be grasped easily by the human hand. The body 18 includes a top end 28 and a bottom end 30. The top end 28 includes a raised portion 32 integrally connected to a land portion 34 through an arcuate surface 36. The button 14 projects through a slot 38 formed in the land portion 34 and the arcuate surface 36.

The bottom end 30 of the main body 18 includes a circular opening 40 through which opening 40 the particulate material 12 is deposited into a storage compartment 42 formed interiorly of the main body 18. An end cap 44 threadably connects to the bottom end 30 to close the circular opening 40 and maintain the material 12 in the sprayer 10. (FIG. 2).

The button 14 and the piston 16 are integrally formed as by plastic injection molding or similar conventional manufacturing process. The button 14 is biased by spring 46 to a position wherein a finger pad 48 of the button is essentially flush with and coplanar with the raised portion 32 of the main body 18. The integral piston 16 is of disc shape and extends radially from a longitudinal axis of the main body 18 to sealingly contact the inner surface 50. The air compartment 52 defined by the inner surface 50 of the main body 18 extends downwardly from the top end 28 a predetermined distance equal to the stroke of the piston 16 as established by manually depressing the button 14.

A bulkhead or middle portion 54 separates the air compartment 52 from the storage compartment 42. The bulkhead 54 is separately formed, as by injection molding. During assembly of the sprayer 10, the bulkhead 54 is inserted through the circular opening 40 into the main body 18 and connected to the inner surface 50 at a preselected location in any conventional manner. The bulkhead 54 includes a cavity 55 into which the one-way valve 29 is seated. The one-way valve 29 is made of flexible material like rubber or a polymer. As shown, the valve 29 is a "beak" valve, but could be of other non-return valve designs.

The piston 16 includes an integral central post 56 lying along the longitudinal axis of the sprayer 10 and projecting downwardly from the piston 16 directly under the finger pad 48 of the button 14. The spring 46 is coaxial with the central post 56, which post 56 is inserted into the spring 46. The bulkhead 54 includes an upward sleeve or guide 58 which is circumscribed by the spring 46.

Figure 5:
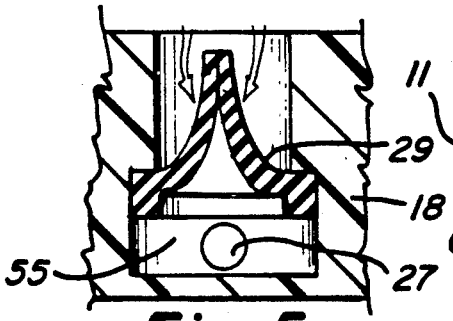
FIG. 5 is an enlarged fragmentary sectional view taken in the plane of line 5—5 of FIG. 2.

Manually actuating the button 14 causes the piston 16 to descend into the air compartment 52 and compresses the spring 46 about the central post 56 and the sleeve or guide 58. (FIG. 2). As the piston 16 descends in the air compartment 52, positive air flow from the air compartment 52 enters the air passageway 20. Air flow out of the sprayer 10 along the relief passageway 27 is prevented by the one-way valve 29. (FIG. 5). The air passageway 20 includes an inlet 60 formed by drilling, molding or similar process in a top planar surface 62 of the bulkhead 54. From the inlet 60, the air passageway 20 turns through an elbow to extend radially away from the longitudinal axis of the sprayer 10 toward the vertical discharge tube 24 and the outlet 26. The vertical discharge tube 24 frictionally fits into a bore 61 formed in the bulkhead 54. The outlet orifice 22 of the discharge tube 24 extends into the air passageway 20 and restricts the cross-sectional area of the air passageway 20 through which air flows, defining the venturi opening 64.

A low pressure area 66 is defined adjacent to the outlet orifice 22 of the discharge tube 24. The low pressure area 66 acts with the discharge tube 24 to pull the particulate material 12 from the storage compartment 42 and out the outlet 26.

The end cap 44 includes a raised central portion 68 which directs the material 12 downwardly to a peripheral feed trough 70 adjacent to an input orifice 72 of the discharge tube 24.

In operation, the button 14 and integral piston 16 are depressed into the air compartment 52. (FIG. 2). Air under pressure is forced into the inlet 60 and directed along the air passageway 20. The venturi opening 64 increases the velocity of the positive air flow in the air passageway 20, creating the low pressure area 66. The particulate material 12, which is directed into the feed trough 70, and/or is located in the discharge tube 24, is drawn up the discharge tube 24-and dispersed into air exiting through the outlet 26 as the spray 11. The particulate material 12 is deposited in an amount depending on the extent to which the piston 16 is depressed. Release of the piston 16 creates some back pressure along the air passageway 20. Any of the particulate material 12 deposited in the air passageway 20 downstream of the venturi opening 64, and not discharged, might be drawn back into the air passageway 20, or even the air compartment 52. This is undesirable and might ultimately cause corrosion, blockage or deterioration of the seal between the piston 16 and the interior surface 50. To help control this problem, the outlet orifice 22 of the discharge tube 24 extends partially across the passageway 20 and the one-way valve and relief passageway 27 are operative during negative air flow to prevent air flow in the passageway 20.

Any back pressure along the air passageway 20 will draw the material 12 toward the outlet orifice 22 where the material 12 will be physically blocked from further travel up the air passageway 20 by the outlet orifice 22. The orifice 22 includes a chamfer surface 65, which angles downwardly from the venturi opening 64 to a position flush with the air passageway 20. The orifice 22 is of substantially the same diameter as the air passageway 20, so that any material 12 suspended in a back flow will strike the discharge tube 24, and because of the chamfer surface 65, drop down the tube 24 and remain in the tube 24 until discharged, or will drop into the storage compartment 42.

During a negative air flow situation (FIGS. 3 and 4), the one-way valve 29 opens under the negative pressure created in the air compartment 52 relative to air pressure outside the sprayer 10. The one-way valve 29 must open at a relatively low pressure differential between the pressure in the air compartment 52 and that in the cavity 55 so that the majority of negative air flow into the air compartment 52 occurs along the relief passageway 27 and through the return valve 29, rather than along air passageway 20. Whatever negative air flow occurs along the air passageway 20 will be less than what occurs during positive air flow. This reduces the likelihood that the low pressure area 66 will develop a sufficient low pressure to draw any particulate material 12 into the passageway 20 during negative air flow.

Although the present invention has been described with a certain degree of particularity, it is understood that the present disclosure has been made by way of example, and changes in detail or structure may be made without departing from the spirit of the invention, as defined in the appended claims.

I claim:

1. A sprayer for particulate material, comprising in combination:

an elongated tubular main body separated into at least one air compartment and at least one storage compartment for the particulate material;

means for moving air mounted in the air compartment;

an air passageway providing air flow communication between the air compartment and the exterior of the main body: and a discharge tube mounted within the tubular body extending into the storage compartment, said discharge tube having one end insertable within the particulate material in the storage compartment and a second end having an outlet orifice extending partially across and in air flow communication with said air passageway, a venturi opening in the air passageway located adjacent to said second end, said venturi opening further defined by a chamfer formed at the second end of said discharge tube, said chamfer extending partially across said air passageway, an upstream edge of said chamfer defining said venturi opening and a downstream edge of said chamber lying substantially flush with said air passageway, whereby movement of the means for moving air within said air compartment creates positive air flow from the air compartment to the exterior of the tubular body along the air passageway, which positive air flow passes past the venturi opening at an increased velocity creating a low pressure area at said second opening of said discharge tube to withdraw particulate material from the one end of said discharge tube and into the air passageway and then to the exterior of the main body; and a relief passageway providing air flow communication between the air compartment and the exterior of the tubular body, said relief passageway having air flow control means mounted therein for limiting positive air flow from moving along said relief passageway and allowing some negative air flow from the exterior of the main body into the air compartment.

2. The invention as defined in claim 1 wherein said discharge tube has substantially the same outside diameter as the inside diameter of the passageway.

3. The invention as defined in claim 1 wherein said means for moving air is a piston integrally connected with a button near a top end of said tubular body, said piston slidable along an inner surface of the air compartment, said button adapted to be manually actuated.

4. The invention as defined in claim 3 wherein a bottom end of said main body is threadably connected to an end cap, said bottom end having a circular opening therein closed by said end cap, said end cap having a relatively raised portion and a trough portion, whereby particulate material on the raised portion moves toward the trough portion, said trough portion being adjacent to said one end of said discharge tube.

5. The invention as defined in claim 1 wherein said air compartment includes means for biasing said air moving means away from said air passageway.

6. The invention as defined in claim 1 wherein said air compartment is separated from said storage compartment by a bulkhead lying generally in a plane perpendicular to a longitudinal axis of said tubular body, and said air passageway being formed radially through said bulkhead.

7. A sprayer for particulate material, comprising in combination:

a hollow body separated by a bulkhead into an upper air compartment and a lower storage compartment, said upper air compartment having a piston slidable therein and said lower storage compartment holding said particulate material, an air passageway formed through said bulkhead providing air flow communication from said air compartment to the exterior of said tubular body, said passageway partially closed by a discharge tube extending partially across said air passageway to define a venturi opening, said discharge tube substantially the same diameter as the air passageway and having an outlet orifice angling downstream along the air passageway away from the venturi opening, said discharge tube extending into said storage compartment to communicate particulate material from said storage compartment into said air passageway and out of the tubular body upon movement of the piston downwardly in said air compartment moving air through said venturi opening, and a relief passageway having air flow control means mounted therein for providing one-way air flow communication from the exterior of said tubular body into said air compartment.

8. The invention as defined in claim 7 wherein the discharge tube is substantially the same diameter as the air passageway and an outlet orifice of said discharge tube angles downstream along the air passageway away from the venturi opening.

9. The invention as defined in claim 8 wherein said button is biased away from the bulkhead by a spring.

10. The invention as defined in claim 8 wherein said main body includes an opening at an upper end thereof, said opening receiving a button integrally connected to said piston, whereby manual actuation of the button depresses the piston into the air compartment.

11. The invention as defined in claims 1 or 7 wherein said air flow control means includes a one-way valve mounted in said air relief passageway.

* * * * *